US005377721A

United States Patent [19]

Kiyohiro et al.

[11] Patent Number: 5,377,721

[45] Date of Patent: Jan. 3, 1995

[54] CONTROL APPARATUS FOR ELECTROVISCOUS FLUID

[75] Inventors: Noriaki Kiyohiro, Kofu; Kazutoshi Ito, Aichi, both of Japan

[73] Assignee: CKD Corporation, Aichi, Japan

[21] Appl. No.: 182,555

[22] Filed: Jan. 18, 1994

[51] Int. Cl.[6] ..... F15C 1/04

[52] U.S. Cl. ..... 137/807; 137/827; 92/143; 91/405

[58] Field of Search ..... 137/807, 827, 13; 92/143; 91/405

[56] References Cited

U.S. PATENT DOCUMENTS

| | | | |
|---|---|---|---|
| 3,548,853 | 12/1970 | McEver | 137/827 |
| 4,342,334 | 8/1982 | Stangroom | 137/806 |
| 4,532,853 | 8/1985 | Stangroom | 137/807 |
| 4,742,998 | 5/1988 | Schubert | 137/807 |
| 4,782,927 | 11/1988 | Sproston et al. . | |
| 4,840,112 | 6/1989 | Bhadra et al. . | |
| 5,158,109 | 10/1992 | Hare, Jr. | 137/517 |
| 5,267,584 | 12/1993 | Smith | 137/13 |

FOREIGN PATENT DOCUMENTS

| | | |
|---|---|---|
| 63-144150 | 6/1988 | Japan . |
| 1-144374 | 6/1989 | Japan . |
| 1317105 | 5/1973 | United Kingdom . |

*Primary Examiner*—A. Michael Chambers
*Attorney, Agent, or Firm*—Finnegan, Henderson, Farabow, Garrett & Dunner

[57] ABSTRACT

A control apparatus for an electroviscous fluid has a pair of electrodes between which the electroviscous fluid is disposed and a control device for applying nearly-trapezoidal shaped pulses positive and negative voltages alternately across the electrodes to control viscosity of the electroviscous fluid. The control apparatus changes gradually a voltage value when switching between the positive voltage and the negative voltage.

6 Claims, 11 Drawing Sheets

(I) SQUARE WAVE ALTERNATING VOLTAGE IN CASE OF SLEW RATE (SPEED OF CHANGE OF VOLTAGE) OF 180V/mm/μsec (a)

(b)

(II) NEARLY-TRAPEZOIDAL WAVE ALTERNATING VOLTAGE IN CASE OF 5V/mm/μsec (a)

(b)

CONTROL APPARATUS FOR ELECTROVISCOUS FLUID

BACKGROUND OF THE INVENTION

1. Field of the Invention

The present invention relates to a control apparatus for an electroviscous fluid of which viscosity changes remarkably in accordance with intensity of an external electric field.

2. Discussion of the Prior Art

In an official bulletin of the Japanese patent publication NO. 144150/1988, there has been proposed a speed control apparatus wherein a speed of an actuator, such as a cylinder or the like, which is driven by an electroviscous fluid applied thereto as working oil, is controlled by controlling the intensity of an external electric field given to the electroviscous fluid.

Generally the electroviscous fluid used is a fluid in which disperse phase particles composed of silica, cellulose, various ion-exchange resin and the like are dispersed and suspended into such an electrically insulating disperse medium as silicone oil or the like. When the electroviscous fluid is subjected to the external electric field, there occurs the Winslow effect in which viscosity of the fluid is remarkably increased to induce a large shearing stress. With this Winslow effect it is possible to control the viscosity of the fluid using an electric signal easily and at a rapid speed of response. Additionally, it is known that an electric voltage for generating the external electric field may be either an alternating voltage or a direct-current voltage.

In the control apparatus which utilizes of the electroviscous fluid for generating an electric field by applying a direct-current voltage, however, particles tend to move with the lapse of time toward an electrode face and also to deposit on it. Thus, a distance between electrodes is substantially narrowed. As the result, it becomes difficult to correctly control the viscosity of the electroviscous fluid by the direct-current voltage.

For avoiding this, in an official bulletin of the Japanese patent publication NO. 144374/1989, there is proposed a control method for an electroviscous fluid in which a direct-current voltage having its sign changed alternately is applied pulsatingly.

However, there have occurred the following problems in the prior art. When the control method for the electroviscous fluid is used in which the direct-current voltage with its sign changed alternately is applied pulsatingly, a rush current Ta flows when the direct-current voltage changes suddenly, as shown in FIG. 4, resulting in an increase of a quantity of an electric current. This results in the control apparatus for the electroviscous fluid functioning electrically as a capacitor. For coping with the rush current, there has been a problem that the control apparatus, including a transformer, must be larger in size. This has also caused rise in cost of the control apparatus.

Such a large rush current also deteriorates remarkably the electrochemical properties of the electroviscous fluid. Accordingly, there is a problem that durability of the electroviscous fluid becomes bad. When consumption of a current is great, temperature of the electroviscous fluid is raised to change performance of the electroviscous fluid. Thus, it becomes difficult to control the viscosity of the electroviscous fluid accurately. As the result, there is a problem that the speed or the like of the electroviscous fluid may not be stably controlled.

In case a sinusoidal or triangular waveform pulse signal is used as an alternating pulse signal, it is possible to prevent generation of the rush current. However, usage of the sinusoidal or triangular waveform pulse signal changes an absolute value of an electric voltage value. Accordingly, there is a problem in case a cylinder is used for precise transfer, because chattering vibrations are induced on movement of the cylinder, as shown in FIG. 7. This figure indicates vibrations of a piston when the cylinder has been actuated by applying an alternating sinusoidal waveform voltage to the electroviscous fluid. Assuming that the axis of abscissas is taken as a time axis and the axis of ordinates is taken as a displacement X, a speed V and an acceleration A of the cylinder, chattering vibrations B are induced on the piston, as shown by the acceleration A.

SUMMARY OF THE INVENTION

To resolve the above-mentioned problems, it is, therefore, a primary object of the present invention to provide a control apparatus for an electroviscous fluid capable of decreasing a consuming current and restricting chattering vibrations in an actuator, such as driving cylinder or the like, which is actuated by the electroviscous fluid applied thereto.

According to the present invention, the foregoing object is attained by providing a control apparatus for an electroviscous fluid having a pair of electrodes between which the electroviscous fluid is disposed and control means for applying pulse-shaped positive and negative voltages alternately across the electrodes to control viscosity of the electroviscous fluid, wherein the control means changes gradually a voltage value when switches over the positive voltage and the negative voltage.

It is preferable that the positive and negative voltages are given by a nearly-trapezoidal pulse signal waveform.

With the present invention, an electric voltage is applied to the electroviscous fluid by the electrodes of the speed control apparatus and the pulse-shaped positive and negative electric voltages are alternately applied across the electrodes by the control means. Thus, the viscosity of the electroviscous fluid is controlled by the control means.

In this instance, the control means changes gradually the voltage value when switching between the positive voltage and the negative voltage. Further, the speed of response of the electroviscous fluid is late, because it is, for instance, a few milliseconds. Thus, the shearing stress may not be changed largely even if the voltage value is gradually changed.

Namely, a consuming current is reduced more than 20% as compared with the case of a square waveform, because a slew rate indicative of a changing rate of the voltage is set in a range of 3–15 V/mm/μsec. In this case, the slew rate is the value into which the difference between the maximum of an absolute value of a positive or negative voltage and the maximum of an absolute value of a negative or positive voltage is divided by time required for change of the difference.

As previously described, the control means applies a pulse signal with the positive and negative voltages alternately and changes gradually the voltages. Accordingly, it is possible to make the rush current small. As the result, the consuming current for controlling the electroviscous fluid may be reduced.

Since the rush current may be made small, it is possible to restrain the electrochemical deterioration of the electroviscous fluid and to thereby extend the life of the electroviscous fluid.

Since the consuming current may be reduced, it is possible to restrain the rise in temperature of the electroviscous fluid. Accordingly, performance of the electroviscous fluid is maintained unchangeable to enable stable control of the speed of the electroviscous fluid.

Furthermore, the transformer may be constructed in a compact size, because the consuming current may be reduced. This results in lowering of cost. The viscosity of the electroviscous fluid is reduced in its fluctuation to maintain in a constant a braking force given to the slider. Thus, chattering vibrations are not induced on the slider, enabling control of the driving cylinder and the like at a precise speed.

BRIEF DESCRIPTION OF THE DRAWINGS

Other objects, features and advantages of the present invention will be readily appreciated from the following detailed description of a preferred embodiment thereof when considered with reference to the accompanying drawings, in which.

DESCRIPTION OF THE PREFERRED EMBODIMENT

Hereinafter, an embodiment of a speed control apparatus for an electroviscous fluid actuated driving cylinder in accordance with the present invention will be explained with respect to the accompanied drawings.

Figure 1:
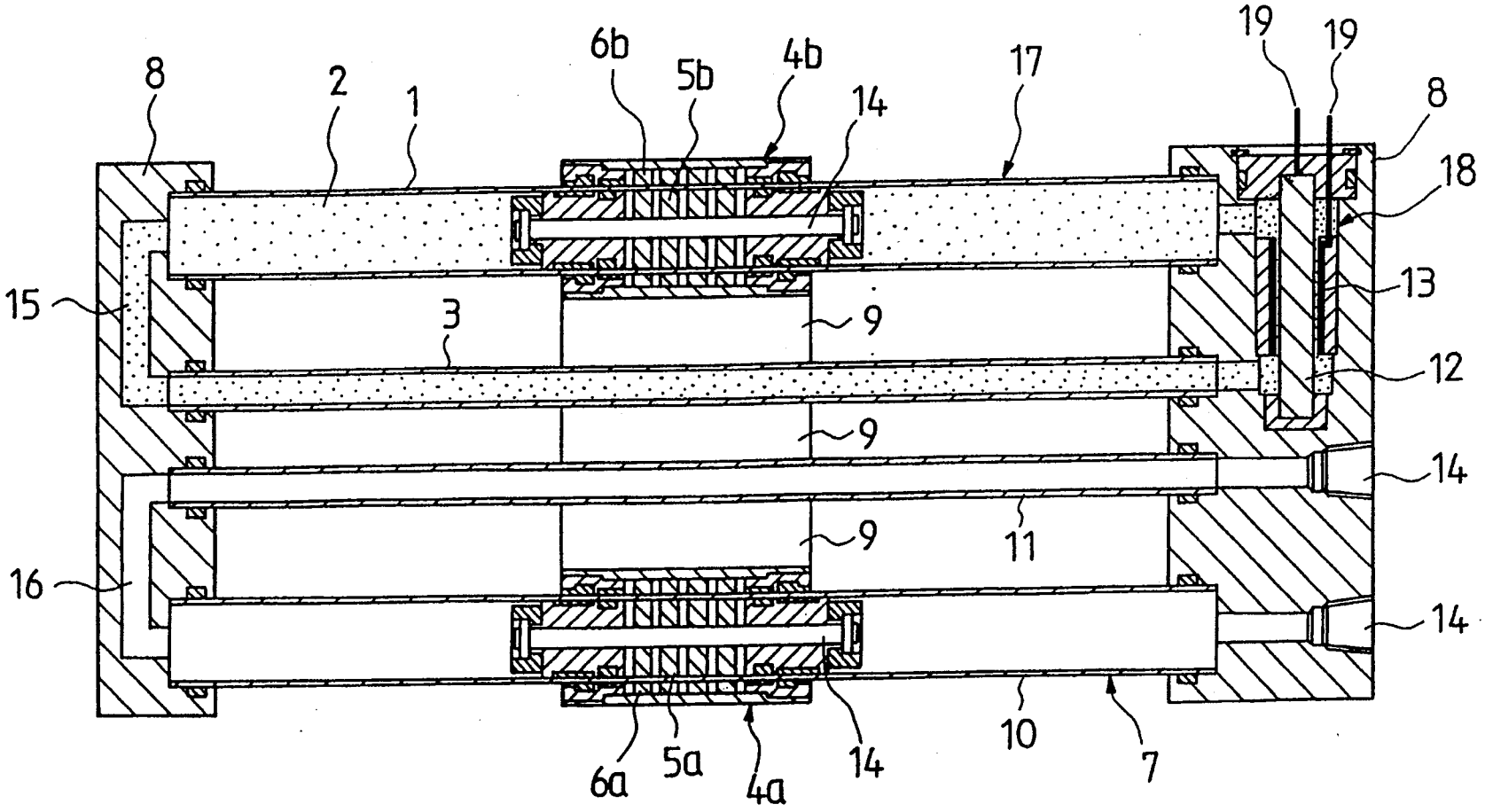
FIG. 1 is a cross-sectional view indicative of the construction of a speed control apparatus for a driving cylinder.

FIG. 1 indicates cross-sections of an electroviscous fluid actuated driving cylinder 7 and a braking cylinder 17. Four hollow pipes composed of a cylinder tube 10, an air tube 11, an oil tube 3 and a main oil tube 1 are engaged at their both ends into a pair of end blocks 8, 8 respectively.

The driving cylinder 7 and braking cylinder 17 used in the embodiment each are a rodless cylinder having no rod, respectively. Thus, a piston engaged slidably into each of the cylinder and main oil tubes 10 and 1 is constructed by coupling a plurality of piston-side magnets 5*a*, 5*b* to each other by a bolt 14. Sliders 4*a*, 4*b* composed of a plurality of slider-side magnets 6*a*, 6*b* are provided on outer peripheries of the cylinder and main oil tubes 10 and 1 at locations corresponding to the piston-side magnets 5*a*, 5*b*, respectively. With this construction, the slider 4*a* provided on the outer periphery of the driving cylinder 7 is coupled by a connecting member 9 with the slider 4*b* provided on the outer periphery of the slider 4*b* to thereby slide integrally with it.

A right side chamber of the driving cylinder 7 communicates with an air port 14, whereas a left side chamber of the driving cylinder 7 communicates with an air port through a passage 16 formed within an interior of the end block 8 and the air tube 11.

A right side oil chamber of the braking cylinder 17 communicates with an upper portion of a speed control apparatus 18 mounted within an interior of the end block 8, whereas a left side chamber of the braking cylinder 17 communicates with a bottom portion of the speed control apparatus 18 through another passage 15 formed within the interior of the end block 8 and the oil tube 3.

The speed control apparatus 18 is constructed by a pipe-shaped outside electrode 13 and a pillared inside electrode 12 assembled coaxially within the outside electrode 13. Wires 19 for applying an electric voltage thereacross are connected to the outside and inside electrodes 13 and 12. Interiors of the braking cylinder 17, oil tube 3 and speed control apparatus 18 are filled with an electroviscous fluid 2. In the embodiment, for the electroviscous fluid 2, a fluid is used in which disperse phase particles composed of silica, cellulose, various ion-exchange resin and the like are dispersed and suspended into silicone oil.

Figure 2:
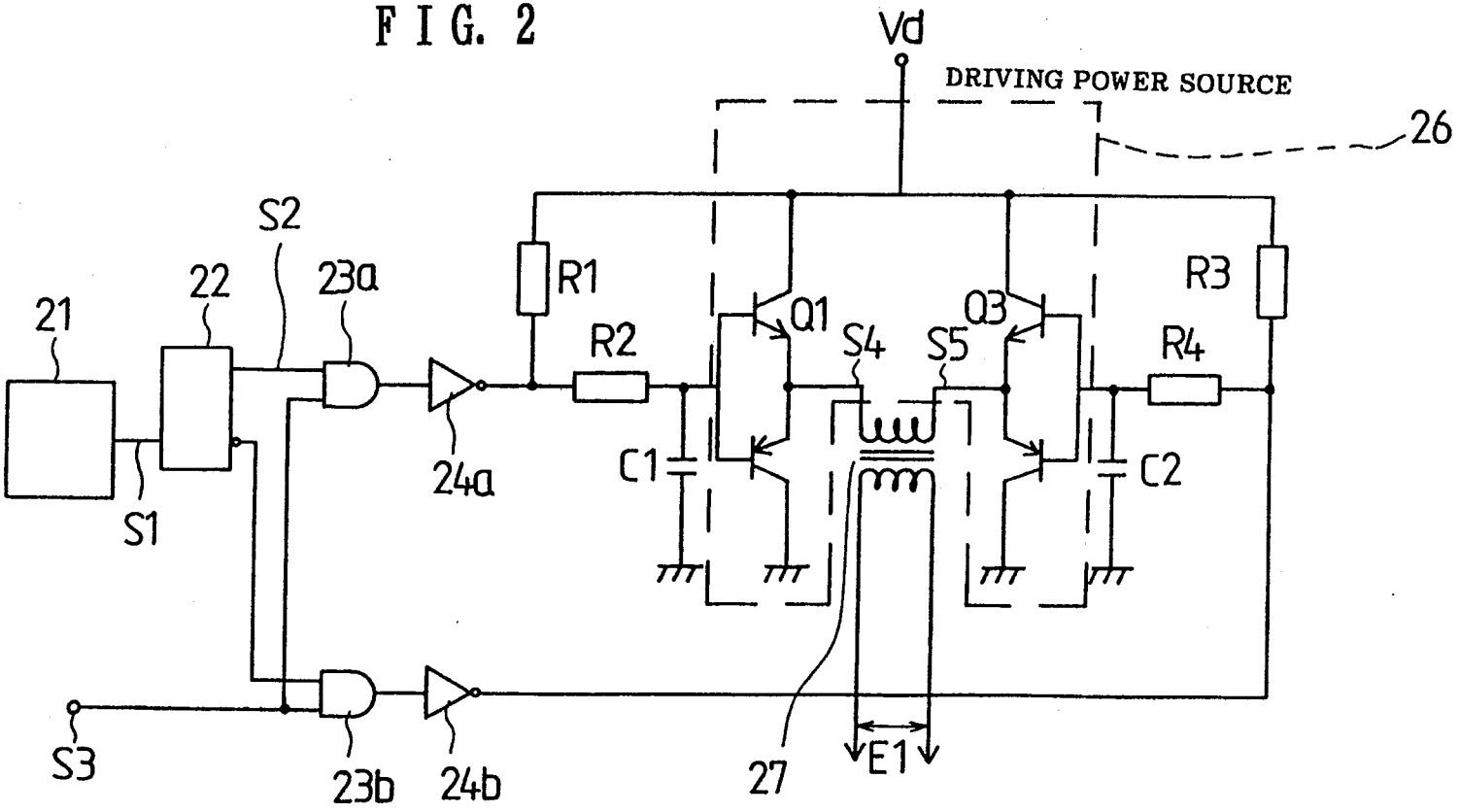
FIG. 2 is a circuit diagram indicating construction of a control apparatus for an electroviscous fluid according to the present invention.

Next, construction of control means for controlling the speed control apparatus 18 will be explained. FIG. 2 is a block diagram of a control circuit for applying an electric voltage across the outside and inside electrodes 13 and 12.

The control circuit is provided with an oscillator 21(OSC) including an astable multivibrator and the like. A D-flip flop 22 is connected to the oscillator 21, and two AND-gates 23 are connected to the D-flip flop 22. Open- collector buffers 24*a*, 24*b* are connected to the two AND-gates 23*a*, 23*b* respectively, a complementary emitter follower circuit 26 is connected to the AND-gates 24*a*, 24*b*, and a small-sized transformer 27 is also connected to the complementary emitter follower circuit 26. Furthermore, a control signal S3 issued from a central control circuit (not shown) is inputted to the two AND-gates 23*a*, 23*b*.

Next, operation of the control means having the above-mentioned construction will be explained with reference to a timing chart shown in FIG. 3.

The oscillator 21 generates an alternating square wave pulse signal S1 having a frequency which is twice as high as a predetermined alternating output frequency. The D-flip flop 22 receives the square wave pulse signal S1 from the oscillator 21 to convert it into a pulse signal S2 having low and high level widths defined by a ratio of one to one. To divide the frequency of the square wave pulse signal S1 into a half is the reason why superposition of a direct-current component on an output waveform may be avoided by maintaining a duty ratio of the pulse signal S2 correctly into fifty percents. As the result, it is possible to prevent magnetic saturation in an iron core of the transformer. Furthermore, it is necessary that tile frequency of the pulse signal S2 is more than one Hz. This is the reason why particles in the electroviscous fluid 2 are deposited on a electrode portion, which deteriorates performance of the speed control apparatus, in case the frequency of the pulse signal S2 is under one Hz.

The AND-gates 23*a*, 23*b* receive, from the central control apparatus, a control signal S3 of voltage supply required when the braking cylinder 17 is given braking necessary for actuating the driving cylinder 7 at a predetermined speed. When the control signal S3 is maintained in its low level, outputs of the AND-gates 23*a*, 23*b* are held in their low levels, and the open collector buffers 24*a*, 24*b* are maintained in their OFF states.

Two capacitors C1, C2 are charged through resistors R1, R2, R3 and R4 by a driving power source with a voltage Vd to accumulate electric charges corresponding to the voltage Vd. Accordingly, both the input side voltages of the complementary emitter follower circuit 26 become the voltage Vd of the driving power source to each other. Thus, a potential difference across a primary winding of the transformer 27 becomes zero V, and a voltage E1 supplied from a secondary winding of the transformer 27 to the electroviscous fluid 2 becomes zero V. As the result, the electroviscous fluid 2 holds fluidity thereof without a braking force applied thereto.

While the control signal S3 is maintained in its high level, the AND-gate 23*a* outputs a signal into which a square wave pulse signal is divided in its frequency by the D-flip flop 22, whereas the AND-gate 23*b* outputs a signal having a half-phase shifted waveform of the output of the AND-gate 23*a*. When the output of the AND-gate 23*a* is a high level, then, an output of the open collector buffer 24*a* becomes a low level in response to which the capacitor C1 starts to discharge through the resistor R2. A waveform at this stage is defined by a time function of $Vd\cdot(1-e^{a})$, wherein $a=t/(C1\cdot R2)$. This discharging voltage from the capacitor C1 is outputted to a common terminal S4 of transistors Q1, Q2 of the complementary emitter follower circuit 26 with its waveform maintained substantially as it is and is in turn applied to the primary winding of the transformer 27.

When the output of the AND-gate 23*a* returns a low level, next, the capacitor C1 is again charged through the resistors R1, R2. A voltage waveform at this stage is defined by $Vd\cdot e^{b}$, wherein $b=\{C1\cdot(R1+R2)\}$. In case a circuit constant is set to be $R2>>R1$, then, it is possible to disregard asymmetry between positive and negative waveform portions.

Meanwhile, the circuit elements at the side of the AND-gate 23*b* operate like the circuit elements at the side of the AND-gate 23*a*. In this instance, an output of the open collector buffer 24*b* at the side of the AND-gate 23*b* becomes a low level while the output of the AND-gate 23*a* is maintained in its low level.

Figure 3:
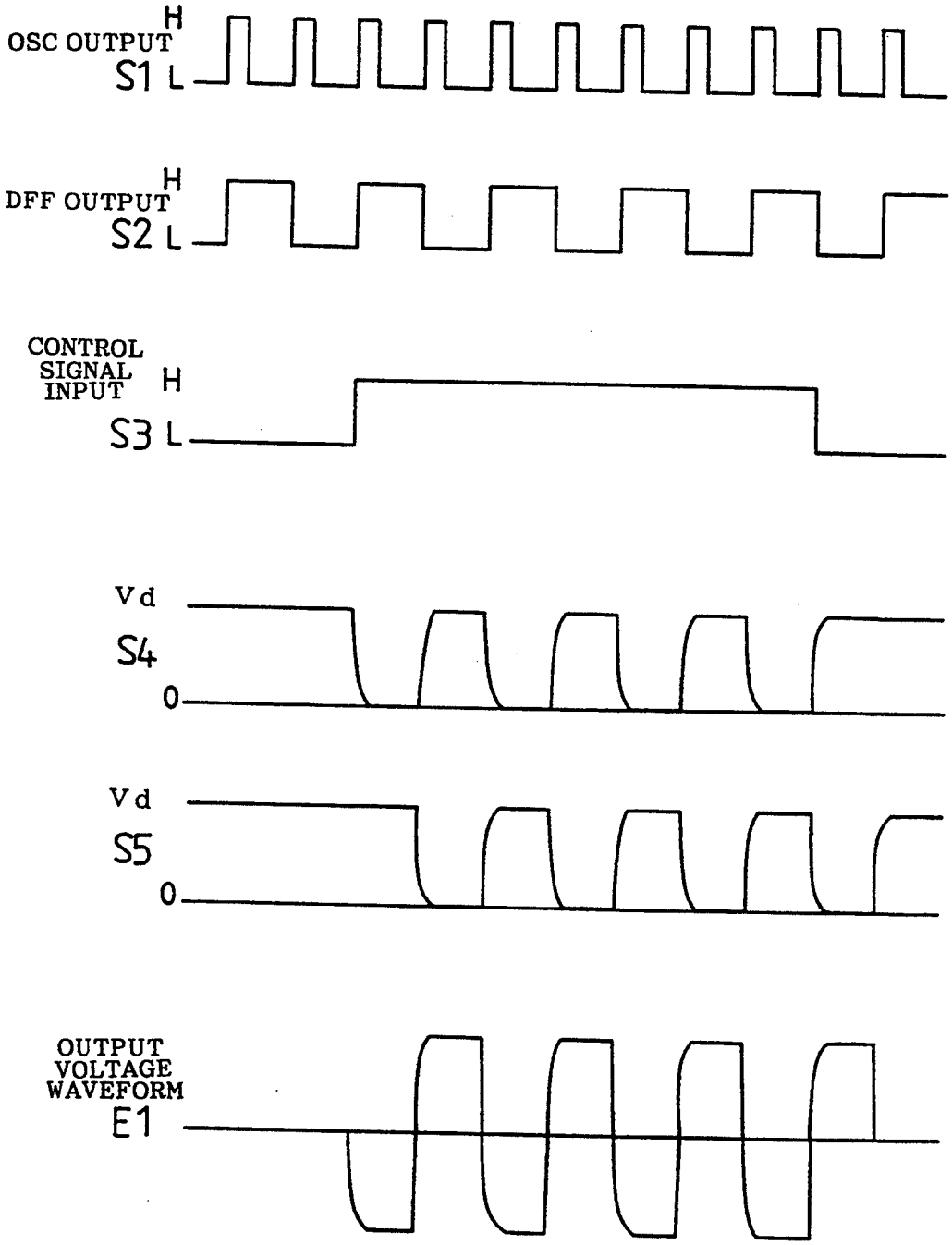
FIG. 3 is a time chart illustrating operation of a circuit of a control apparatus for the electroviscous fluid.
Figure 4:
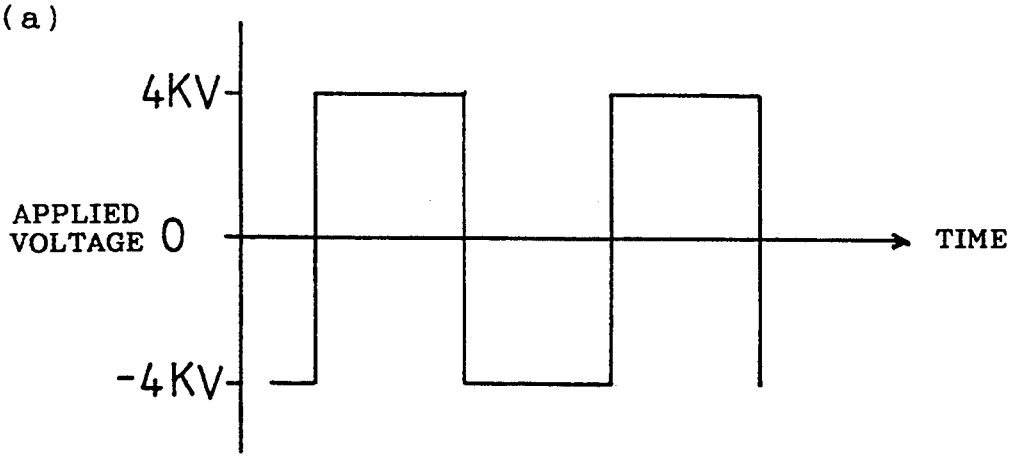
FIG. 4 is a time chart showing a current quantity in case an alternating square waveform pulse signal is applied to the electroviscous fluid.
Figure 4:
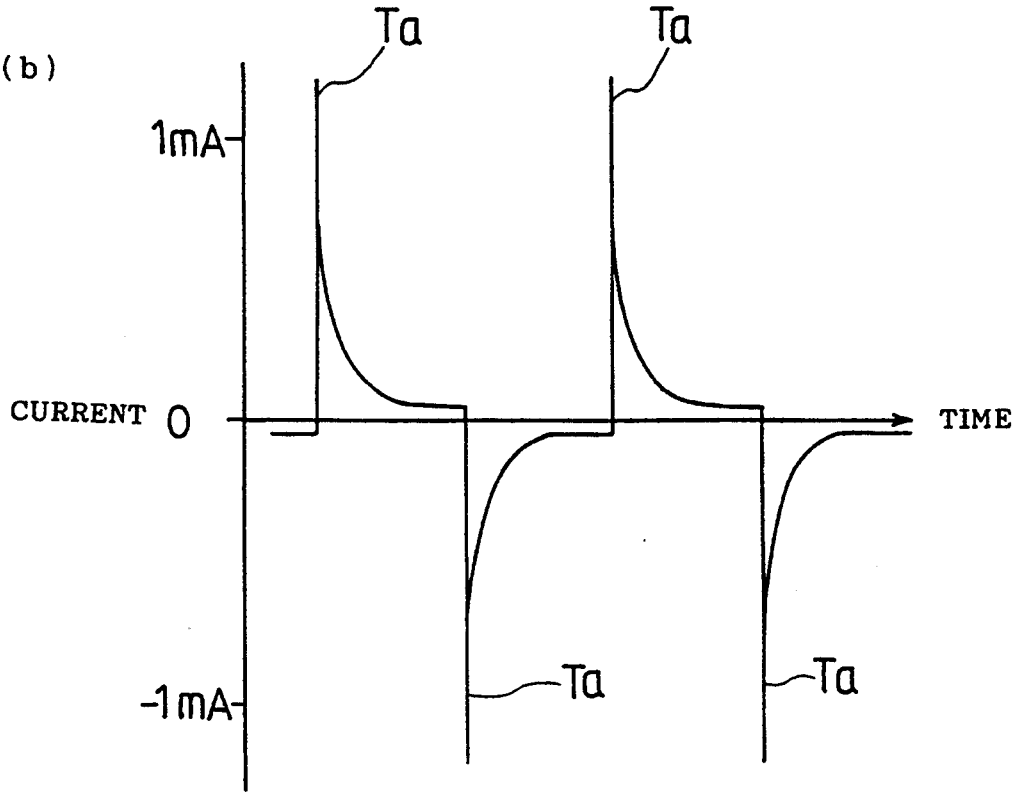

Accordingly, output voltages S4, S5 of the complementary emitter follower circuit 26 are applied to both the terminals of the primary winding of the transformer 27 with waveforms shown in FIG. 3, respectively. Thus, a waveform of a synthetic voltage S6 applied across the primary winding becomes nearly a trapezoidal waveform. In this case, a changing speed of a voltage when positive and negative voltages are gradually changed, that is, a slew rate, may be adjusted by properly selecting the capacitors C1, C2 and resistors R1, R2, R3 and R4 in the circuit. At the secondary winding of the transformer 27, the voltage S6 is stepped up and appears as a driving voltage E1 for the electroviscous fluid 2, as shown in FIG. 3.

Meanwhile, a change in the voltage applied to the electroviscous fluid 2 is performed by changing the driving voltage Vd with the central control apparatus and a variable driving voltage apparatus (not shown).

Next, operation of the speed control apparatus for the driving cylinder having the above-mentioned construction will be explained. When working air flows into the right side air chamber of the driving cylinder 7, the piston in the cylinder tube 10 moves toward the leftward direction in the figure. When the piston-side magnet 5*a* constructing the piston moves, the slider-side magnet 6*a* which is attracted with a magnet force to the piston-side magnet 6*a* by way of the cylinder tube moves together with the piston-side magnet 5*a*, and then the slider 4*a* moves toward the leftward direction in the figure. At this stage, the slider 4*b* mounted on the outer periphery of the braking cylinder 17 operates integrally with the slider 4*a*, because it is integral with the slider 4*a* through the connecting member 9.

When the slider 4*b* moves toward the leftward direction in the figure and the slider-side magnet 6*b* then moves, the piston-side magnet 5*b* which is attracted by a magnet force to the slider-side magnet 6*b* through the cylinder tube moves together with the slider-side magnet 6*b*, and then the piston moves toward the leftward direction in the figure within the main oil tube 1.

When the piston moves within the main oil tube 1, the electroviscous fluid 2 is pushed by the piston in the leftward direction and simultaneously generates a reduced pressure at the right side of the piston. Thus, the electroviscous fluid 2 is moved counterclockwisely in the figure. At this stage, the electroviscous fluid 2 passes through a gap formed by the outside and inside electrodes 13 and 12 in the speed control apparatus 18.

In this case, viscosity of the electroviscous fluid 2 can be increased by an electric field which is generated by an electric voltage applied between the outside and inside electrodes 13 and 12. When the applied voltage between the outside and inside electrodes 13 and 12 is increased, therefore, a moving speed of the slider 4*a* of the driving cylinder 7 is reduced.

Figure 8:
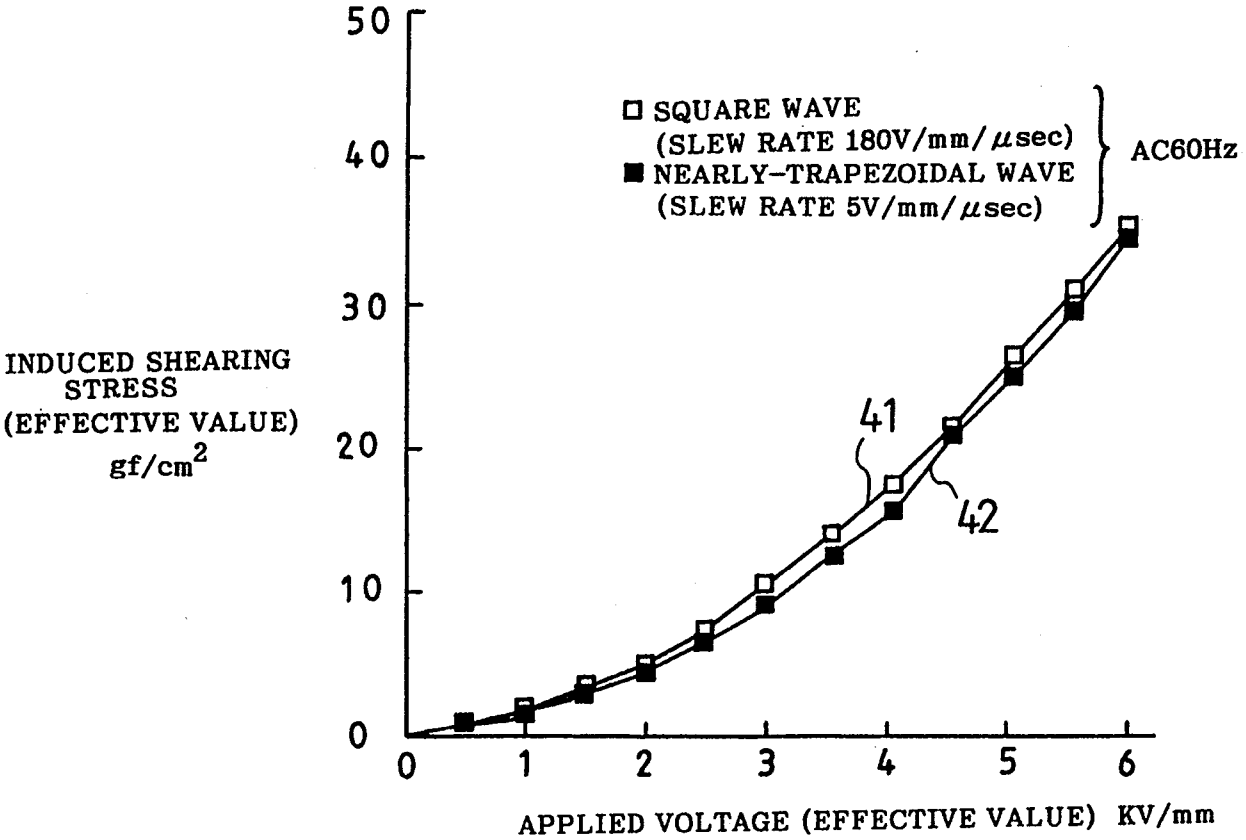
FIG. 8 illustrates data indicating relationship between an applied voltage and an induced shearing stress.

Next, relationship between the slider 4*a* of the driving cylinder 7 and an applied voltage will be explained. FIG. 8 illustrates relationship between an applied voltage (an effective value) indicative of a driving voltage for the electroviscous fluid and a shearing stress induced in the electroviscous fluid. The reference numeral 41 indicates data in case an alternating square waveform voltage of 60 Hz is used as the applied voltage, and the reference numeral 42 indicates data in case an alternating nearly-trapezoidal waveform voltage of 60 Hz is used as the applied voltage. In this case, a changing ratio of the applied voltage at positive to negative or vice versa switching-over timing of the square waveform is 80 V/mm/μsec, whereas a changing ratio of the applied voltage at positive to negative or vice versa switching-over timing of the nearly-trapezoidal waveform is 5 V/mm/μsec.

As shown in FIG. 8, an induced shearing stress generated in the electroviscous fluid 2 is substantially identical to each other in both the cases of the alternating square waveform voltage 41 and alternating nearly-trapezoidal waveform voltage 42. Thus, change of a table moving speed of the driving cylinder 7 actuated by the electroviscous fluid 2 is also substantially identical to each other in both the cases of the alternating square waveform voltage 40 and alternating nearly-trapezoidal waveform voltage 39, as shown in FIG. 6.

Figure 9:
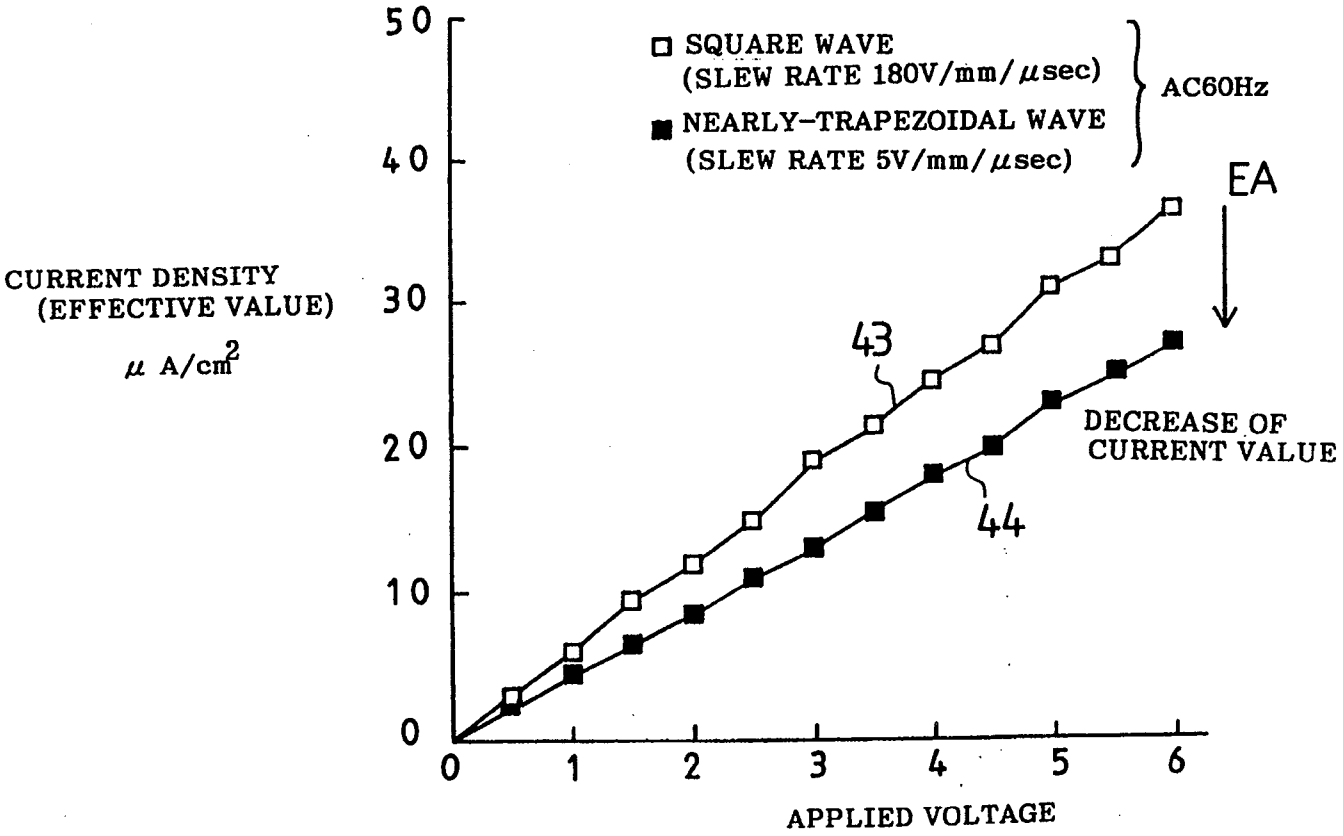
FIG. 9 illustrates relationship between an applied voltage and current density.

Meanwhile, FIG. 9 shows the relationship between an applied voltage (an effective value) indicative of a driving voltage for the electroviscous fluid and current density (an effective value). The reference numeral 43 indicates data in case an alternating square waveform voltage of 60 Hz is used as the applied voltage, and the reference numeral 44 indicates data in case an alternating nearly-trapezoidal waveform voltage of 60 Hz is used as the applied voltage. As understood from these data, the amount of a current required for the nearly-trapezoidal waveform voltage 44 decreases as compared with the case of the square waveform voltage 43 by a quantity shown by an arrow mark EA in the figure.

Figure 5:
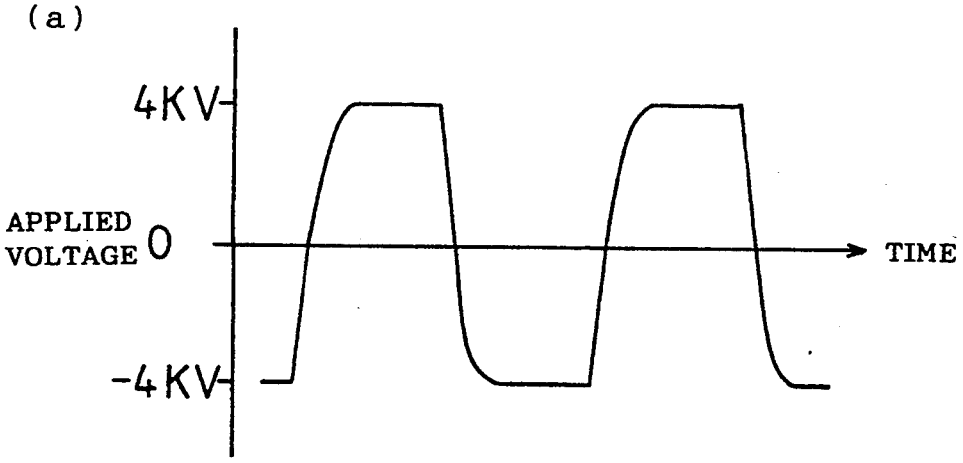
FIG. 5 is a time chart showing a current quantity in case an alternating trapezoidal waveform pulse signal is applied to the electroviscous fluid.
Figure 5:
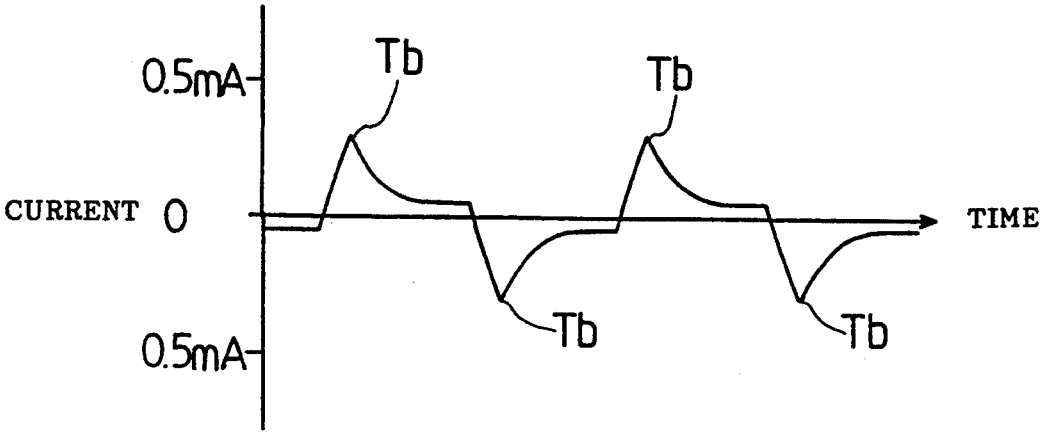
Figure 6:
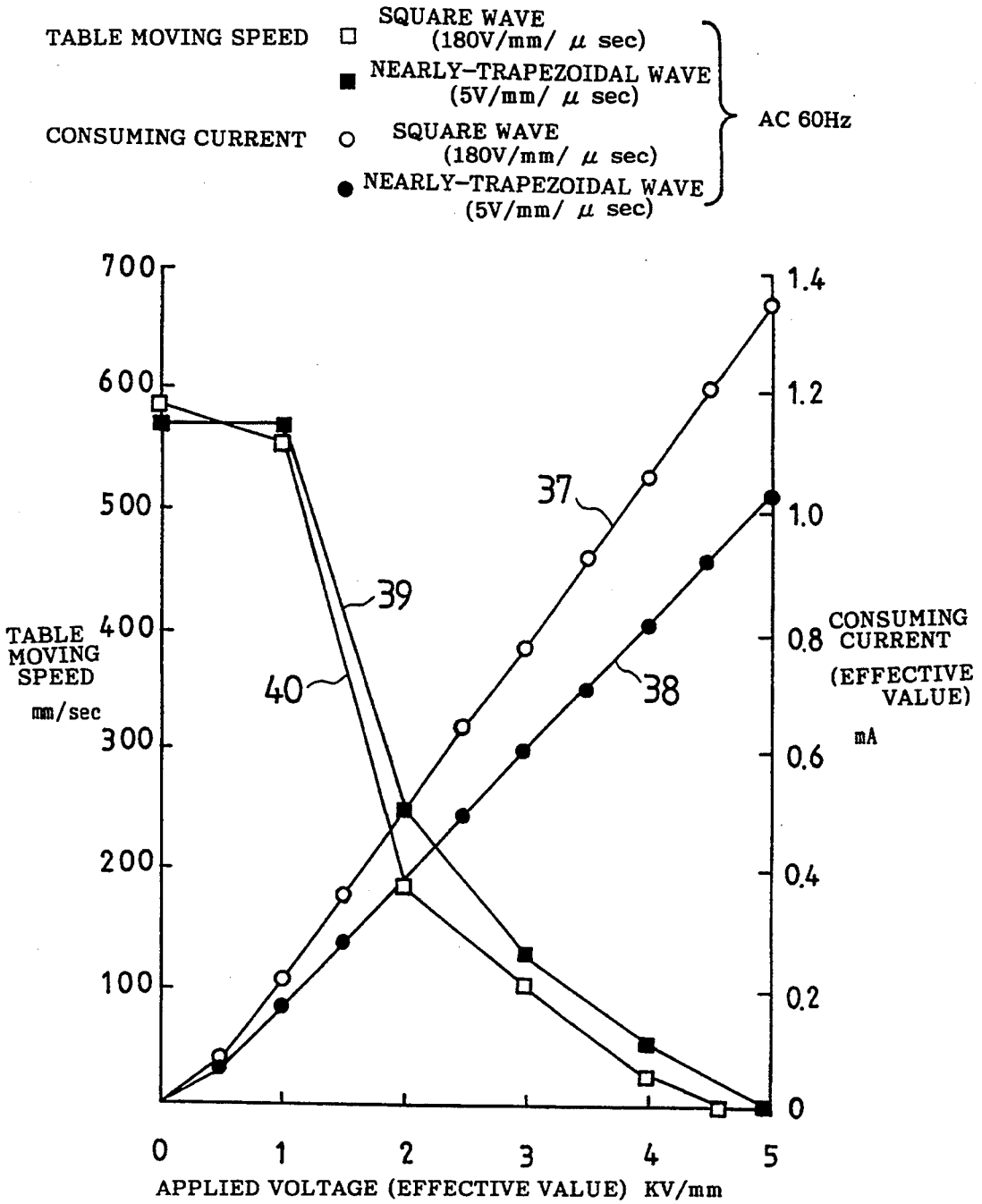
FIG. 6 shows data indicative of relationship between an applied voltage and a speed of a slider.

Accordingly, in the speed control apparatus for the driving cylinder actuated by the electroviscous fluid 2, a current required for the nearly-trapezoidal waveform voltage 38 decreases largely compared with the case of the square waveform voltage 37, as shown by data of FIG. 6. This is the reason why the rush current Tb flowing when an induced shearing stress is generated in the electroviscous fluid may be decreased down to about a third when the alternating nearly-trapezoidal waveform voltage, is used, as shown in FIG. 5. Since the rush current is decreased, the transformer may be also smaller in size, resulting in decrease of cost.

In the embodiment, the central control apparatus stores, as table data, data 39 when an alternating nearly-trapezoidal waveform voltage of 60 Hz is used as an applied voltage and gives speed instruction to the speed control apparatus for the electroviscous fluid 2 in the form of the applied voltage. Then, a nearly-trapezoidal waveform pulse signal with positive and negative voltages each having a constant absolute value, respectively, is alternately always applied across the outside and inside electrodes 13 and 12 through the wires 19.

Figure 7:
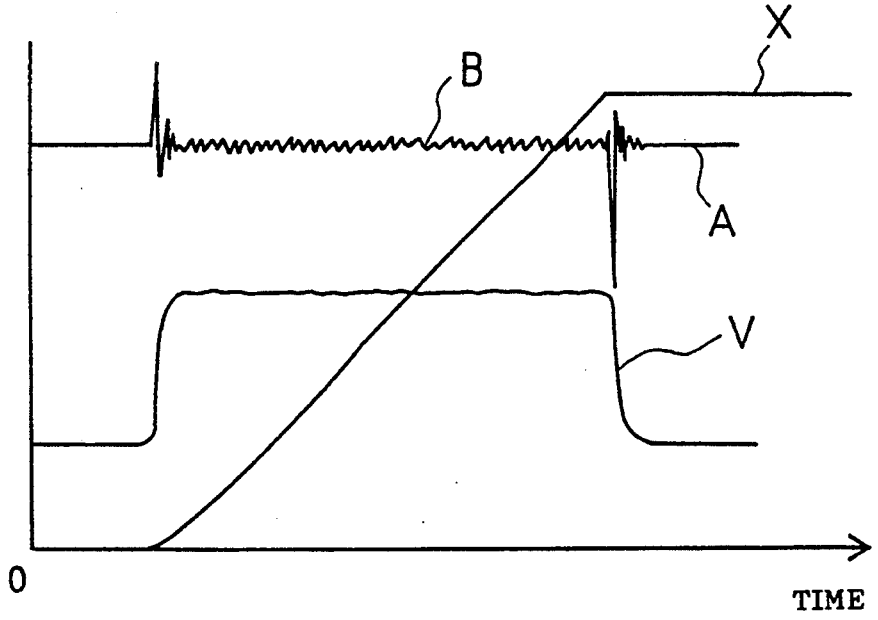
FIG. 7 is a time chart showing vibrations when a driving cylinder of the embodiment is actuated with an alternating sinusoidal waveform signal.
Figure 10:
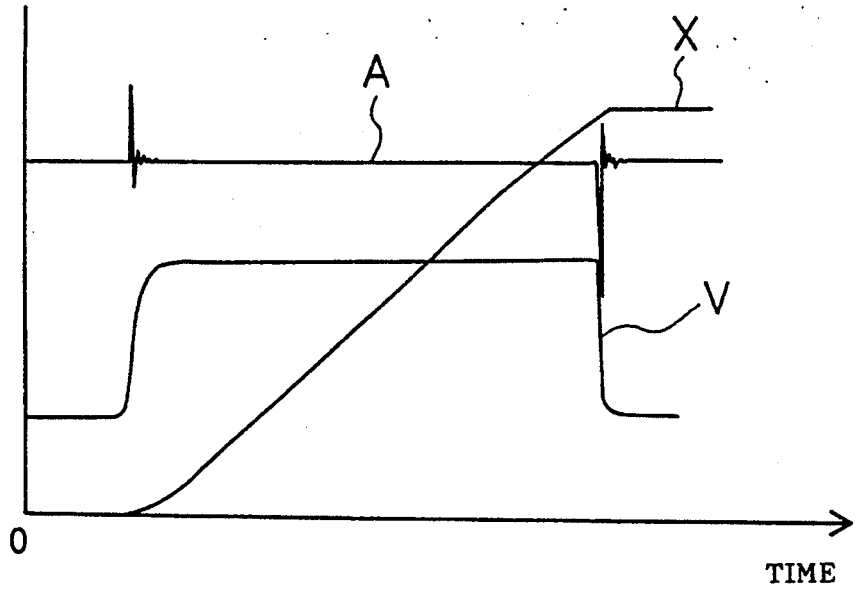
FIG. 10 is a time chart indicating vibrations when the driving cylinder is actuated.

When the nearly-trapezoidal waveform pulse signal with positive and negative voltages having a constant absolute value respectively, is always applied across the electrodes, a braking force given to the electroviscous fluid 2 is maintained at a constant value. Assuming that, as shown in FIG. 10, the axis of abscissas is taken as a time axis and the axis of ordinates is taken as a displacement X, a speed V, and an acceleration A of the driving cylinder, no chattering vibrations B of the slider as previously shown in FIG. 7 are induced, as shown by the acceleration A. Thus, the control apparatus for the electroviscous fluid according to the present invention may be used as a control apparatus for a driving cylinder which needs precise feed.

Furthermore, explained is the case that an absolute value of the trapezoidal pulse signal with positive and negative voltages has fluctuated. Even if the absolute value of the trapezoidal pulse signal fluctuates, it is confirmed experimentally that chattering vibrations may not be induced on the driving cylinder when the absolute value is maintained in a range of 90–100%.

As described above, with the speed control apparatus for the driving cylinder of the embodiment, the trapezoidal pulse signal of positive and negative voltages having an absolute value, respectively, is alternately always applied across the electrodes when the control means controls a speed of the driving cylinder. Consequently, there are no fluctuations in viscosity of the electroviscous fluid 2. Thus, the a braking force issued on the slider is always maintained in a constant to prevent chattering vibrations of the slider.

In this case, a quantity of the rush current may be reduced largely because the electric voltage value is gradually changed when the positive or negative voltages of the absolute value changes into the other polarity. It is therefore possible to prevent deterioration of the electroviscous fluid 2 and also to stably control the speed of the driving cylinder. The transformer also may be reduced in size to thereby realize a decrease of cost.

With the speed control apparatus for the driving cylinder of the embodiment, furthermore, the speed of the driving cylinder is changed by ceaselessly applying alternately the trapezoidal pulse signal of positive and negative voltages with a constant absolute value, respectively, to the electrodes and also changing the absolute value of the square pulse signal. Thus, it is possible to easily and accurately control the speed of the driving cylinder without chattering vibrations induced on the slider.

In addition, it is desirable that the pulse waveform is a trapezoidal waveform ideally, such that switching over between the positive voltage and the negative voltage is gradually carried out, namely a slew rate is decreased. However, it complicates the control apparatus to realize an accurate trapezoidal waveform. This results in large increases in cost. Thus, in the embodiment, the rush current is made small with low cost by using a nearly-trapezoidal waveform as a control pulse waveform, and a consuming current is then decreased.

Figure 11:
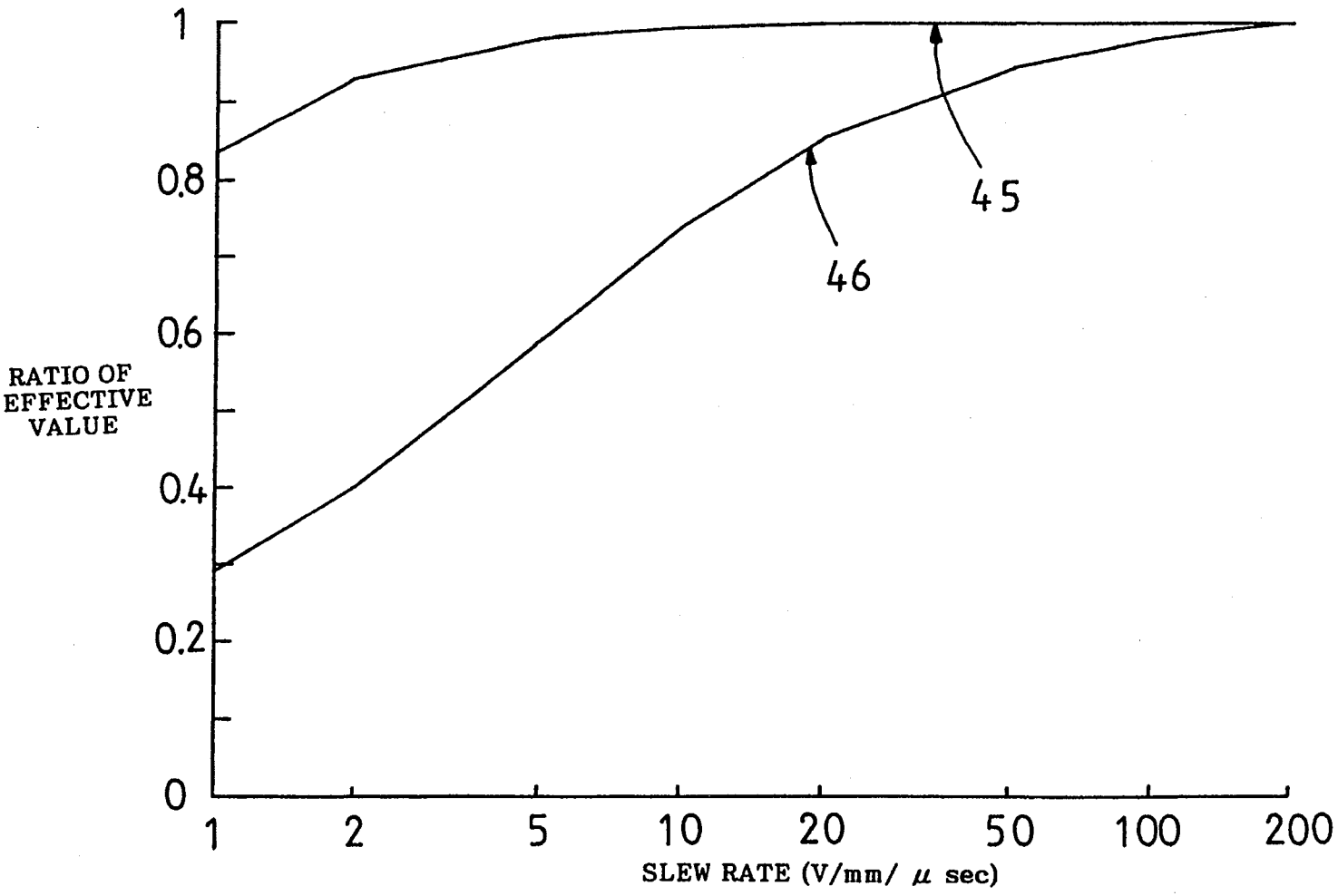
FIG. 11 shows data representing the relationship between a slew rate and both of a shearing stress and current density.

Furthermore, it is experimentally confirmed that the consuming current may be decreased more than 20% as compared with the case of the square waveform when the slew rate is smaller than 15 V/mm/μsec, as shown by a data line 46 of FIG. 11.

With a sinusoidal waveform (slew rate 2.2 V/mm/μsec), chattering vibrations are induced on the driving cylinder and the like by change in viscosity of the electroviscous fluid. It is necessary to restrain lowering of the shearing stress to less than 5% for preventing induction of the chattering vibrations. As shown by a data line 45 of FIG. 11, it is possible to restrain lowering of the shearing stress to less than 5% when the slew rate is larger than 3 V/mm/μsec. Accordingly, it is desirable to maintain the slew rate in a range of 3–15 V/mm/μsec.

Although in the embodiment a time rate between positive and negative pulse waveforms of the applied voltage is 5:5, it may be changed in necessity. With experimental confirmation, it is necessary that the time rate between positive and negative pulse waveforms of the applied voltage is maintained in an intermediate ratio from 8:2 to 2:8. This is the reason why particles in the electroviscous fluid are deposited on the electrode portion, which deteriorates the control performance against viscosity, when the time ratio deviates from the intermediate ratio. As various changes could be made in the above embodiment without departing from the scope of the present invention, it is intended that all matter contained in the above description or shown in the accompanying drawings shall be interpreted as illustrative and not in a limiting sense.

What is claimed is:

1. A control apparatus for controlling an electroviscous fluid, the apparatus comprising:

a pair of electrodes between which the electroviscous fluid is disposed; and control means for applying pulses of positive and negative voltages alternately across the electrodes to control viscosity of the electroviscous fluid, said control means applying each pulse of positive voltage and negative voltage gradually so that the positive and negative voltages are applied as nearly-trapezoidal pulse signal waveforms.

2. A control apparatus as claimed in claim 1, wherein the control means applies the pulses of said positive voltage at a frequency greater than one Hz.

3. A control apparatus as claimed in claim 1, wherein the control means maintains a ratio between the time said positive voltage and said negative voltage are applied at an intermediate ratio from between 8:2 to 2:8.

4. A control apparatus as claimed in claim 1, wherein the control means applies each pulse of positive and negative voltages with a voltage value that changes at a rate of between 3 and 15 V/mm/$\mu$m sec.

5. A control apparatus as claimed in claim 4, wherein the control means applies the pulses of said positive voltage at a frequency greater than one Hz.

6. A control apparatus as claimed in claim 4, wherein the control means maintains a ratio between the time said positive voltage and said negative voltage are applied at an intermediate ratio from 8:2 to 2:8.

* * * * *